US006197485B1

(12) United States Patent
Cellone et al.

(10) Patent No.: US 6,197,485 B1
(45) Date of Patent: Mar. 6, 2001

(54) PHOTOGRAPHIC ASSEMBLAGE COMPRISING A SILVER HALIDE PHOTOGRAPHIC ELEMENT SEALED IN A CLOSED VESSEL

(75) Inventors: Luigi Cellone, Albisola Marina; Brunella Fornasari, Cairo Montenotte/Ferrania; Giovanni Giusto, Altare, all of (IT)

(73) Assignee: Minnesota Mining & Manufacturing Company, St. Paul, MN (US)

( * ) Notice: Subject to any disclaimer, the term of this patent is extended or adjusted under 35 U.S.C. 154(b) by 0 days.

(21) Appl. No.: 08/126,897

(22) Filed: Sep. 27, 1993

(30) Foreign Application Priority Data

Nov. 12, 1992 (IT) ..... MI92A2592

(51) Int. Cl.[7] ..... G03C 3/00; G03C 1/34

(52) U.S. Cl. ..... 430/501; 430/496; 430/608; 430/612; 430/605; 430/626; 430/512; 430/552; 430/553

(58) Field of Search ..... 430/347, 496, 430/501, 567, 607, 608, 612, 605, 626, 552, 553, 512

(56) References Cited

U.S. PATENT DOCUMENTS 2,472,631 * 6/1949 Stauffer et al. ..... 430/608
2,566,245 * 8/1951 Trivelli et al. ..... 430/608
2,566,263 * 8/1951 Trivelli et al. ..... 430/608
3,900,323 * 8/1975 MacLeish et al. ..... 430/608
4,211,837 * 7/1980 Blake et al. ..... 430/502
4,618,570 * 10/1986 Kadowaki et al. ..... 430/605
4,892,808 * 1/1990 Harbison et al. ..... 430/607
5,578,435 * 11/1996 Ihama ..... 430/501

FOREIGN PATENT DOCUMENTS

439069 * 7/1991 (EP) .
62-168143 * 7/1987 (JP) .

* cited by examiner

*Primary Examiner*—Mark F. Huff
(74) *Attorney, Agent, or Firm*—Mark A. Litman & Assoc.

(57) ABSTRACT

A photographic assemblage comprising a silver halide photographic light-sensitive element comprising at least one sulfur and gold sensitized silver halide emulsion layer, said element comprising chlorinated s-triazine hardeners and photographically useful chemical compounds containing cyano groups, and a closed vessel in which the element is closed and stored at a constant relative humidity, is protected against HCN gas, which may evolve from photographic addenda included in the light-sensitive element to cause fog in the silver halide emulsion layers, by the addition of a palladium compound, in a silver halide emulsion layer and/or an adjacent layer thereto, as scavenger for HCN gas released from the element.

19 Claims, No Drawings

PHOTOGRAPHIC ASSEMBLAGE COMPRISING A SILVER HALIDE PHOTOGRAPHIC ELEMENT SEALED IN A CLOSED VESSEL

FIELD OF THE INVENTION

The present invention relates to a photographic assemblage and, more particularly, to a silver halide photographic element sealed in a closed vessel.

BACKGROUND OF THE INVENTION

Silver halide photographic light-sensitive elements are normally stored before use in a closed moistureproof vessel. For example, silver halide photographic color elements are most often enclosed in light-tight cartridges, such as 135, 110 and 120 cartridges; said cartridges including the light-sensitive element are sealed in a closed, air-tight vessel to protect the light-sensitive element against degradation of photographic properties caused by external moisture or noxious gases and stored therein before use in photographic cameras. Other examples include photographic elements in the form of sheets, bands or industrial coatings which are stored in closed vessels before use or converting and wherein the internal volume in the closed vessel is very low compared with the surface area of the photographic element.

A problem has been observed of uniform fog occurring in photographic elements sealed in closed vessels. This has been observed in particular with photographic elements containing silver halide emulsion layers which have been sensitised with sulfur and gold.

U.S. Pat. Nos. 4,892,808, 4,211,837 and 3,900,323 disclose that said uniform fog can be reduced by the use of heavy metal compounds capable of scavenging noxious substances produced by carbon black used in the opaque backing sheet placed on the side of the photographic element opposite the side bearing the silver halide emulsion layers. According to U.S. Pat No. 4,892,808 said fog is caused by hydrogen cyanide (HCN) gas which evolves from the carbon black of the associated backing material and binds with gold in sulfur and gold sensitized silver halide grains, thus leaving silver sulfide fog centers. Examples of heavy metal compounds include compounds of palladium, gold, platinum, iridium, rhodium and osmium.

JP-A-62-168143 discloses that fog occurring in a light-sensitive element during storage in a closed vessel can be reduced by decreasing the humidity in the vessel. However, when humidity is decreased to a value at which fog is satisfactory reduced, problems of static failure, low curling and fragility can occur.

EP 439,069 discloses that fog in photographic elements, containing silver halide emulsion layers sensitised with sulfur and gold, stored in a closed vessel can be caused by a noxious gas released from said photographic element. On the basis of their experiments, the inventors of EP 439,069 have found that HCN was the gas released from the photographic element and accumulated in the closed vessel to undesirably change photographic properties. According to their experiments, synthetic polymers (e.g., couplers, matting agents, binders) synthesized by an azo-based polymerization initiator containing a cyano group, ultraviolet absorbers containing a cyano group, or dyes containing a cyano group have been found to be the source of HCN gas production and removing this cause was a most preferably means in order to suppress releasing of HCN gas from the photographic element.

JP-A-03-236043, JP-A-03-236044, JP-A-03-236048, JP-A-03-236049 and JP-A-03-236050 all relate to means for reducing deterioration of photographic characteristics caused by HCN gas released by keeping a photographic element comprising silver halide emulsion layers sensitised with sulfur and gold in an air-tight vessel able to keep fixed humidity.

The present invention is based on the discovery of an additional source of HCN gas in photographic elements stored in a closed vessel. It has been found that fog in silver halide photographic elements stored in closed vessel is mainly caused by HCN gas released by chlorinated s-triazine compounds used as hardeners for the hydrophilic binders (such as gelatin) of the element. It is believed that HCN is produced during the hydrolisis of cyanuric chloride used as starting material for the synthesis of chlorinated s-triazine hardeners. The fact that the source of HCN gas released from a light-sensitive element can be a chlorinated s-triazine hardener was very surprising, since it is not known in the art.

Both photographically useful chemical compounds comprising cyano groups, such as those described in EP 439,069, and chlorinated s-triazine hardeners are compounds widely used in silver halide color photographic elements and substituting them to suppress releasing of HCN gas from the element may cause problems as far as other photographic performances of the element are concerned. Accordingly, it is an object of the present invention to provide silver halide photographic elements in which fog formation is small when the element is stored in a closed vessel without removing the above compounds from the element.

U.S. Pat. Nos. 2,566,245 and 2,566,263 describe certain heavy metal compounds as fog-inhibitors for silver halide emulsions to improve keeping under high humidity and high temperature conditions, as in tropical regions. There is no suggestion in these patents that fog is caused by HCN released from a photographic element sealed in a closed vessel. EP 439,069, cited above, states that serious problems of degradation in photographic properties arise when heavy metal compounds are added to the light-sensitive element. U.S. Pat. No. 4,892,808, cited above, suggests that the heavy metal compound be placed in a location remote from the silver halide emulsion layer. U.S. Pat. No. 2,472,631 discloses fogging properties of cyano palladite anions (which anions should be formed by the reaction of palladium compouds with HCN).

SUMMARY OF THE INVENTION

In accordance with the present invention there is provided a photographic assemblage comprising:

- a silver halide photographic light-sensitive element comprising at least one sulfur and gold sensitized silver halide emulsion layer, said element comprising chlorinated s-triazine hardenes and chemical compounds containing cyano groups, and
- a closed vessel in which the element is closed and stored at a constant relative humidity,
- characterized in that the element contains, in a silver halide emulsion layer and/or an adjacent layer thereto, a palladium compound as scavenger for HCN gas released from the element.

It has been found that the addition of palladium compounds to the photographic element prevents the increase of fog when the element is stored in a closed vessel at around normal humidities, without negatively affecting other photographic properties (such as sensitivity and contrast), even though the photographic element includes chemical addenda which tend to evolve HCN gas during storage of the element. The palladium compounds have resulted unique, among heavy metal compounds such as gold, iridium, rhodium and osmium compounds, in reducing fog caused by HCN gas.

DETAILED DESCRIPTION OF THE INVENTION

In the present invention, the palladium compound means a divalent palladium salt or a tetravalent palladium salt. The palladium salt is preferably represented by the formulas $R_2PdX_6$ or $R_2PdX_4$ wherein R represents hydrogen, an alkali metal atom (e.g., sodium, potassium), or an ammonium group, and X represents halogen (e.g., chlorine, bromine, iodine). More specifically, $K_2PdCl_4$, $(NH_4)_2PdCl_4$, $Na_2PdCl_4$, or $(NH_4)_2PdCl_4$ is preferable.

The amount of palladium compound varies with the particular compound, the location in the photographic element, the particular silver halide photographic element, the amount of HCN gas evolved by said element. Said amount is generally in the range of 0.01 to 1 mg/g of silver, more preferably in the range of 0.05 to 0.5 mg/g of silver.

In the present invention, the palladium compounds are added before coating to the silver halide emulsions, and/or to the coating compositions forming a layer of the photographic element which is contiguous or adjacent to the silver halide emulsion layer.

Chemical compounds containing cyano groups for use in the photographic elements of the present invention include synthetic polymers prepared by an azo-based polymerization initiator containing a cyano group, cyan dye-forming couplers containing a cyano group, ultraviolet absorbers containing a cyano group, or dyes containing a cyano group.

Typical examples of synthetic polymers include polymeric couplers, polymeric matting agents, polymeric ultraviolet absorbers, polymeric latexes used to incorporate additives in a photographic layer, polymeric latexes used to improve physical properties of a film, polymeric binders, polymeric thickening agents, and other polymers used in the photographic element (such as in a undercoat layer, an interlayer, an emulsion layer, a protective layer, a backing layer, an antistatic layer, an antihalation layer, etc.) for various applications in addition to those described above. Examples of said synthetic polymers and polymerization initiators containing a cyano group are described, for example, in EP 439,069.

Examples of cyan dye-forming couplers containing a cyano group for use in the present invention are described in, e.g., U.S. Pat. Nos. 4,333,999, 4,451,559, 4,465,766 and 4,554,244. Preferred examples of cyan dye-forming couplers containing cyano groups are those represented by the following general formula:

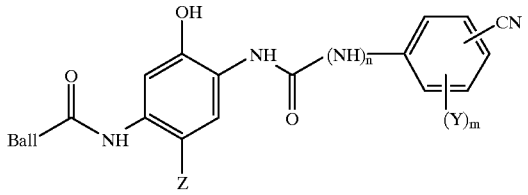

wherein Ball is a ballast group, Z is hydrogen or a group removable upon coupling rection with oxidized product of a color developing agent, Y is hydrogen, halogen, hydroxy, nitro or monovalent organic group, n is an integer of 0 to 1, m is an integer of 0 to 4, provided that when m is 2 or more, Y's may be the same or different.

Examples of ultraviolet absorbers containing cyano groups for use in the present invention are described in, e. g., U.S. Pat. Nos. 4,163,671, 4,191,576, 4,309,500, 4,675,352, 4,443,534, 4,431,726, 4,200,464, 3,936,305, 3,533,794, 3,969,907 and 3,215,530, in GB patents 2,083,240, 2,083,239 and 2,083,241, and in EP patent 57,160. Preferred examples of ultraviolet absorbers containing cyano groups are those represented by the following general formula:

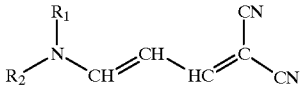

wherein $R_1$ and $R_2$ can be the same or different and represent hydrogen, allyl, alkyl of 1 to 20 carbon atoms including substituted alkyl such as cyanoalkyl, alkoxyalkyl, aryl of 6 to 20 carbon atoms including substituted aryl or cyclic alkyl group of 5 or 6 carbon atoms, except that both $R_1$ and $R_2$ cannot be hydrogen, or taken together $R_1$ and $R_2$ represent the elements necessary to complete a cyclic ammino group as, for example, piperidino, morpholino, pyrrolidino, hexahydrodiazepino and piperazino. Examples of said ultraviolet absorbers are reported in U.S. Pat. Nos. 4,045,229, 4,946,768 and 4,576,908.

Examples of dyes containing a cyano group for use in the present invention are described in, e.g., EP patents 29,412 and 319,999, in U.S. Pat. Nos. 4,770,984, 4,756,995, 4,234,677, 2,089,729, 2,688,541, 3,544,325, 3,563,748, 2,622,980, 3,379,533, 3,540,888 and in GB patents 584,609, 695,874, and 1,561,272.

"Chlorinated s-triazine hardeners" in the present invention means a 1,3,5-triazine containing mobile halogen atoms, such as a) water soluble salts of 2,4-dihalogen-6-hydroxy-1,3,5-triazine corresponding to the general formula:

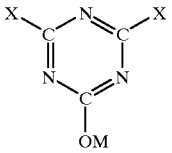

wherein X is halogen (e.g., chlorine, bromine), M represents an alkali or alkaline earth metal, e.g., sodium, potassium, lithium, calcium, barium, or strontium, or a quaternary ammonium group, e. g., tetramethylammonium, tetraethylammonium, tetrapropylammonium, or tetrabutylammonium, b) water soluble salts of 2-halogen-4, 6-dihydroxy-1,3,5-triazine correspond-ing to the general formula:

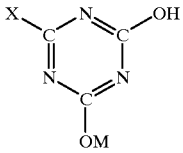

wherein X and M are as described above, and c) is 2,4-dihalogen-6-amino-1,3,5-triazine corresponding to the general formula:

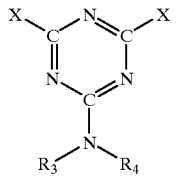

wherein X is as described above and $R_3$ and $R_4$ each independently represents hydrogen, alkyl of 1 to 10 carbon atoms wich may be substituted, aryl of 6 to 10 carbon atoms which may be substituted, or taken together $R_3$ and $R_4$ represent the elements necessary to complete a cyclic ammino group as described above.

In the present invention, "closed vessel" means, e.g., a bag or a case in which the photographic element is closed in moistureproof conditions at a constant relative humidity in the range from 50% to 70% at a temperature of 25° C. Examples of materials used to form the vessel are metals and metal foils such as aluminium plate, tin plate and aluminium foil, glass, polymers such as polyethylene, polystyrene, polycarbonate, polyvinylchloride, polypropylene and polyamide, and laminate materials consisting of various types of polymers in laminate composition with materials such as cellophane, paper and aluminium foils. Said vessels are made moistureproof by various sealing methods, using adhesives, heat sealing, or a patrone as usually used in photography.

As indicated above, the present invention is particularly useful for reducing fog caused by HCN gas in photographic elements containing silver halide emulsions which are chemically sensitized with gold and sulfur or other chalcogenide compound, such as selenium and tellurium. Such sensitization is described, for example, in U.S. Pat. Nos. 2,743,182 and 3,297,447. Among gold compounds for use in the gold sensitization method, gold complex salts (e.g., potassium chloroaurate, potassium aurithiocyanate, auricrichloride, sodium aurithiosulfate and 2-aurosulfobenzothiazolemethochloride, as described in, e.g., U.S. Pat. No. 2,399,083) can be preferably used. In the present invention, the most preferable chemical sensitization is a combination of sufur sensitization and gold sensitization, the sulfur sensitization method preferably using active gelatin or a compound containing sulfur which can react with silver (e.g., thiosulfate, thioureas, thioamides, disulfides or polysulfides, thio-sulfonates, polythionates, element-state sulfur, sulfides, mercapto compounds, and rhodanines). Chemical sensitization is performed at a pH of 4 or more, preferably 5 or more, and most preferably 6 or 6.5 or more, the upper limit of pH being 9 or less, preferably 8.5 or less. Chemical sensitization is normally performed at a pAg of 6 to 10, preferably 7 to 9.

The silver halide photographic element comprising a sulfur and gold sensitized silver halide emulsion, chlorinated s-triazine hardeners, chemical compounds containing cyano groups, and a palladium compound as scavenger for HCN gas released from the element when it is stored in a closed vessel, can be any of the photographic elements know in the art. It can be a simple element comprising one silver halide emulsion layer coated on a polymeric support base or a paper base or a more complex element comprising multiple silver halide emulsion layers. The photographic element can be a black and white element useful for amateur and professional use, including radiographic use, or it can be a color photographic material useful for forming a color negative image or a color positive image. The photographic element is in particular a color photographic element comprising multiple silver halide emulsion layers which are sensitive to different regions of the visible and/or infrared spectrum, each layer being associated with a color former, such as a dye-forming color coupler, to provide a viewable dye image.

Further details of the photographic elements useful in the present invention are described in Research Disclosures, Items 17643 (December 1978) and 18716 (November 1979), which relate to photographic silver halide materials, addenda (e.g., chemical sensitizers, sensitivity increasing agents, spectral sensitizers, supersensitizers, brighteners, antifoggants and stabilizers, light absorbers, filter dyes, UV absorbers, stain preventing agents, dye image stabilizers, hardeners, binders, plasticizers, lubricants, coatings aids, surfactants, antistatic agents), processing and systems, and in Research Disclosure, Item 18431, (August 1979), which relates to radiographic materials.

The present invention will be described in detail below by way of examples. The present invention, however, is not limited to those examples. In the following examples the following Standard Dmin Test was employed:

Photographic assemblages comprising a multilayer color negative film sealed in a moistureproof bag were evaluated by the amount of fog induced in cyan, magenta and yellow dye-forming layers by noxious substances emanating from the film. The fog appears as an increase of the minimum density (Dmin) of the exposed and developed samples. The standard test procedure is as follows:

Samples of each film were cut in strips having a width of 3.5 cm and a length of 30 cm. The strips were maintained for 24 hours at 80% relative humidity and 21° C. Each strip was placed in a sealed aluminium foil bag lined with polyethylene, taking care to remove most of the air before sealing. The sealed bag was stored at 50° C. and 80% relative humidity for three days, after which the sample was subjected to sensitometry exposure, color development as described in the British Journal of Photography Annual, 1977, pp. 201–205, and measurement of the minimum density.

EXAMPLE 1

Film A was prepared by coating a cellulose triacetate support base, subbed with gelatin, with the following layers in the following order:

(a) a layer of black colloidal silver dispersed in gelatin having a silver coverage of 0.27 g/m$^2$ and a gelatin coverage of 1.33 g/m$^2$;

(b) an intermediate layer containing 0.97 g/m$^2$ of gelatin;

(c) a layer of low sensitivity red-sensitive silver halide emulsion comprising a sulfur and gold sensitized low-sensitivity silver bromoiodide emulsion (having 2.5% silver iodide moles and a mean grain size of 0.18 $\mu$m) at a total silver coverage of 0.71 g/m$^2$, gold coverage of 19.42 $\mu$mole/mole Ag and a gelatin coverage of 0.94 g/m$^2$, containing the cyan-dye forming coupler C-1 (containing a cyano group) at a coverage of 0.354 g/m$^2$, the cyan-dye forming DIR coupler C-2 at a coverage of 0.024 g/m$^2$ and the magenta colored cyan-dye forming coupler C-3 at a coverage of 0.043 g/m$^2$, dispersed in a mixture of tricresylphosphate and butylacetanilide;

(d) layer of medium-sensitivity red-sensitive silver halide emulsion comprising a sulfur and gold sensitized silver chloro-bromo-iodide emulsion (having 7% silver iodide moles and 5% silver chloride moles and a mean grain size of 0.45 $\mu$m) at a silver coverage of 0.84 g/m$^2$, gold coverage of 7.67 $\mu$mole/mole Ag and a gelatin coverage of 0.83 g/m$^2$, containing the cyan-dye forming coupler C-1 (containing a cyano group) at a coverage of 0.333 g/m$^2$, the cyan-dye forming DIR coupler C-2 at a coverage of 0.022 g/m$^2$ and the magenta colored cyan-dye forming coupler C-3 at a coverage of 0.052 g/m$^2$, dispersed in a mixture of tricresylphosphate and butylacetanilide;

(e) a layer of high-sensitivity red-sensitive silver halide emulsion compris-ing a sulfur and gold sensitized silver bromo-iodide emulsion (having 12% silver iodide moles and a mean grain size of 0.11 $\mu$m) at a silver coverage of 1.54 g/m$^2$, gold coverage of 2.81 $\mu$mole/mole Ag and a gelatin coverage of 1.08 g/m$^2$, containing two cyan-dye forming couplers, the coupler C-1 (containing a cyano group) at a coverage of 0.224 g/m$^2$ and the coupler C-4 at a coverage of 0.032 g/m$^2$, and the cyan-dye forming DIR coupler C-2 at a coverage of 0.018 g/m$^2$, dispersed in a mixture of tricresylphosphate and butylacetanilide;

(f) an intermediate layer containing 1.11 g/m$^2$ of gelatin, comprising the 2-chloro-4,6-dihydroxy-1,3,5-triazine gelatin hardener H-1 at a coverage of 0.183 g/m$^2$;

(g) a layer of low sensitivity green sensitive silver halide emulsion comprising a blend of 63% w/w of the low-sensitivity emulsion of layer c) and 37% w/w of the medium-sensitivity emulsion of layer (d) at a silver coverage of 1.44 g/m$^2$, gold coverage of 29.7 $\mu$mole/mole Ag and a gelatin coverage of 1.54 g/m$^2$, containing the magenta-dye forming coupler M-1, at a coverage of 0.537 g/m$^2$, the magenta dye forming DIR coupler M-2 at a coverage of 0.017 g/m$^2$, and the yellow colored magenta dye forming coupler M-3 at a coverage of 0.079 g/m$^2$, the yellow coloured magenta dye forming coupler M-4 at a coverage of 0.157 g/m$^2$, and dispersed in tricresylphosphate;

(h) a layer of high-sensitivity green sensitive silver halide emulsion comprising the emulsion of layer (e) at a silver coverage of 1.60 g/m$^2$, gold coverage of 2.92 $\mu$mole/mole Ag and a gelatin coverage of 1.03 g/m$^2$ containing the magenta dye forming coupler M-1, at a coverage of 0.498 g/m$^2$, the magenta dye forming DIR coupler M-2 at a coverage of 0.016 g/m$^2$, the yellow coloured magenta dye forming coupler M-3 at a coverage of 0.021 g/m$^2$, and the yellow colored magenta dye forming coupler M-4 at a coverage of 0.043 g/m$^2$, dispersed in tricresylphosphate;

(i) an intermediate layer containing 1.06 g/m$^2$ of gelatin;

(j) a yellow filter layer containing 1.18 g/m$^2$ of gelatin, comprising the 2-chloro-4,6-dihydroxy-1,3,5-triazine gelatin hardener H-1 at a coverage of 0.148 g/m$^2$;

(k) a layer of low-sensitivity blue-sensitive silver halide emulsion comprising a blend of 60% w/w of the low-sensitivity emulsion of layer c) and 40% w/w of the medium-sensitivity emulsion of layer (d) at a silver coverage of 0.53 g/m$^2$, gold coverage of 12.32 $\mu$mole/mole Ag and a gelatin coverage of 1.65 g/m$^2$ and the yellow dye forming coupler Y-1 at a coverage of 1.042 g/m$^2$ and the yellow dye forming DIR coupler Y-2 at a coverage of 0.028 g/m$^2$ dispersed in a mixture of diethyllaurate and dibuthylphthalate;

(l) a layer of high-sensitivity blue sensitive silver halide emulsion comprising the emulsion of layer (e) at a silver coverage of 0.90 g/m$^2$, gold coverage of 1.64 $\mu$mole/mole Ag and a gelatin coverage of 1.24 g/m$^2$, containing the yellow dye-forming coupler Y-1 at a coverage of 0.791 g/m$^2$ and the yellow dye forming DIR coupler Y-2 at a coverage of 0.021 g/m$^2$ dispersed in a mixture of diethyllaurate and dibuthyl-phthalate;

(m) a protective layer of 1.28 g/m$^2$ of gelatin, comprising the UV absorber UV-1 (containing two cyano groups) at a coverage of 0.1 g/m$^2$; and (n) a top coat layer of 0.73 g/m$^2$ of gelatin containing 0.273 g/m$^2$ of polymethylmethacrylate matting agent MA-1 in form of beads having an average diameter of 2.5 micrometers, and the 2-chloro-4,6-di-hydroxy-1,3,5-triazine hardener H-1 at a coverage of 0.468 g/m$^2$. The total silver coverage of the silver halide emulsion layers was 6.99 g/m$^2$ and the total gold coverage was 4.97 $\mu$mole/m$^2$.

Film B was prepared by coating a cellulose triacetate support base, subbed with gelatin, with the same layers of Film A, but the gelatin hardener H-1 of layers (f), (j) and (n) was replaced by the equimolecular amounts of gelatin hardener H-2.

Film C was prepared by coating a cellulose triacetate support base, subbed with gelatin, with the same layers of Film A, but the gelatin hardener H-1 of layers (f), (j) and (n) was replaced by the equimolecular amounts of gelatin hardener H-3.

Samples of the Films A, B and C were submitted to the Standard Dmin Test described above. The fog induced by HCN gas released by the components of the film is reported in the following table.

TABLE 1

| | Dmin | | |
|---|---|---|---|
| Film | cyan | magenta | yellow |
| A | 0.55 | 0.38 | 0.29 |
| B | 0.47 | 0.29 | 0.13 |
| B | 0.18 | 0.15 | 0.02 |

From these data, it will seen that chlorinated s-triazine hardeners are the major responsibles for the deterioration of the films in the forced Dmin test. The presence of gold compounds was not able to scavenge HCN gas.

EXAMPLE 2

Film E was prepared similar to Film B of Example 1, but containing potassium tetrachloropalladite (II) of formula $K_2PdCl_4$ in the following layers and amounts: layer (f) and amount 0.4462 mg/m$^2$, layer (i) and amount 0.3194 mg/m$^2$, layer (m) and amount 0.8 mg/m$^2$, to provide a total amount of 1.57 mg/m$^2$ (corresponding to 5.1 $\mu$moles/m$^2$). The palladium salt was added to the aqueous solution of the hardener, which was then added to the coating composition of each intermediate layer.

Film F was prepared similar to Film B of Example 1, but containing potassium tetrachloropalladite (II) of formula $K_2PdCl_4$ in the following layers and amounts: layer (c) and amount 0.174 mg/m$^2$, layer (d) and amount 0.141 mg/m$^2$, layer (e) and amount 0.1 mg/m$^2$, layer (g) and amount 0.21 mg/m$^2$, layer (h) and amount 0.165 mg/m$^2$, layer (k) and amount 0.148 mg/m$^2$, layer (l) and amount 0.082 mg/m$^2$, to provide a total amount of 1.02 mg/m$^2$. The palladium salt was added directly to the coating composition of each silver halide emulsiom layer.

Film G was prepared similar to Film B of Example 1, but containing potassium tetrachloropalladite (II) of formula $K_2PdCl_4$ in the following layers and amounts: layer (f) and amount 0.439 mg/m$^2$, layer (i) and amount 0.4118 mg/m$^2$, layer (m) and amount 0.284 mg/m$^2$, to provide a total amount of 1.135 mg/m$^2$. The palladium salt was added directly to the coating composition of each intermediate layer.

Samples of the Films B, E, F and G were submitted to the Standard Dmin Test described above. The fog induced by HCN gas released by the components of the film is reported in the following table.

TABLE 2

| Film | Dmin cyan | Dmin magenta | Dmin yellow |
|---|---|---|---|
| B | 0.47 | 0.28 | 0.12 |
| E | 0.06 | 0.00 | 0.04 |
| F | 0.04 | 0.00 | 0.02 |
| G | 0.04 | 0.00 | 0.07 |

From these data, it will seen that the palladium compound was effective in reducing the fog in the forced deterioration test, irrespective of its location within the light-sensitive element.

EXAMPLE 3

Film H was prepared similar to Film B of Example 1, but containing potassium tetrachloropalladite (II) of formula $K_2PdCl_4$ in the following layers and amounts: layer (f) and amount 0.188 mg/m$^2$, layer (i) and amount 0.108 mg/m$^2$, layer (j) and amount 0.119 mg/m$^2$, layer (m) and amount 0.199 mg/m$^2$, to provide a total amount of 0.614 mg/m$^2$. The palladium salt was added to the coating compositions of each intermediate layer and yellow filter layer.

Samples of the Films B and H were submitted to the Standard Dmin Test described above. The fog induced by HCN gas released by the components of the film is reported in the following table, as difference between samples submitted to the above test for 2, 4 and 6 days and samples stored in normal conditions of temperature and relative humidity outside the closed vessel.

TABLE 3

| | Dmin (2 days) | | | Dmin (4 days) | | | Dmin (6 days) | | |
|---|---|---|---|---|---|---|---|---|---|
| Film | C | M | Y | C | M | Y | C | M | Y |
| B | 0.16 | 0.09 | 0.03 | 0.49 | 0.22 | 0.05 | 0.67 | 0.30 | 0.10 |
| H | 0.03 | 0.01 | 0.04 | 0.04 | 0.02 | 0.04 | 0.06 | 0.04 | 0.05 |

These data show that the palladium compound was effective to reduce fog in the forced deterioration test.

Samples of the two films, stored in normal coditions of temperature and relative humidity outside the closed vessel, were subjected after three days from coating to sensitometric exposure and color development in accordance with the method described above. The obtained results are summarized in the following table.

TABLE 4

| | Film B | | | Film H | | |
|---|---|---|---|---|---|---|
| | C | M | Y | C | M | Y |
| Dmin | 0.18 | 0.50 | 0.78 | 0.19 | 0.50 | 0.78 |
| Dmax | 1.95 | 2.40 | 2.98 | 1.95 | 2.39 | 2.93 |
| Speed | 1.88 | 2.17 | 2.14 | 1.91 | 2.17 | 2.13 |
| Contrast | 0.60 | 0.62 | 0.68 | 0.60 | 0.61 | 0.68 |

C, M and Y mean, respectively, the cyan dye-forming unit, the magenta dye-forming unit and the yellow dye-forming unit.

TABLE 4-continued

| | Film B | | | Film H | | |
|---|---|---|---|---|---|---|
| | C | M | Y | C | M | Y |

Speed is the sensitivity expressed as −logE (wherein E is exposure in meter-candle-seconds) measured at 0.2 density.
Contrast is the contrast measured in the high-density or shoulder region of each sensitometric curve.

From the data, it will seen that addition of palladium compound does not cause degradation in photographic properties.

An area of 1 m$^2$ of each film was finely cut in a dark room, and released HCN gas was analyzed by the pyridine-pyrazolone absorbimetric method described in EP 439,069. The obtained results are summarized in the following table.

TABLE 5

| Film | HCN released amount (mg/m$^2$) 75° C. × 2 h. | 75° C. × 7 h. | 75° C. × 24 h. |
|---|---|---|---|
| B | 1.2 | 2.15 | 12.18 |
| H | 0.0 | 0.52 | 0.58 |

As it is apparent from Table 5, the palladium compound substantially reduces HCN gas released from the light-sensitive element, despite of the fact that said element comprises chemical compounds and triazine hadeners which produce HCN.

EXAMPLE 4

Film I was prepared by coating a cellulose triacetate support base, subbed with gelatin, with layers (a), (b), (c), (d), (e) and (f) of Film A.

Films L and M were prepared as Film I, but respectively contain-ing 0.050 and 0.201 mg/m$^2$ of $K_2PdCl_4$ in layer (f).

Films N and O were prepared as Film I, but respectively contain-ing 0.063 and 0.256 mg/m$^2$ of $K_2Pd(SCN)_4$ in layer (f).

Films P and Q were prepared as Film I, but respectively contain-ing 0.052 and 0.208 mg/m$^2$ of $HAuCl_4$ in layer (f).

Films R and S were prepared as Film I, but respectively contain-ing 0.081 and 0.328 mg/m$^2$ of $K_2IrCl_6 \cdot 3H_2O$ in layer (f).

Films T and U were prepared as Film I, but respectively containing 0.107 and 0.432 mg/m$^2$ of $Na_3RhCl_6 \cdot 18H_2O$ in layer (f).

Films V and Z were prepared as Film I, but respectively containing 0.056 and 0.228 mg/m$^2$ of $K_2RuCl_5 \cdot H_2O$ in layer (f).

Samples of Films I to Z were submitted to the Standard Dmin Test described above. The fog induced by HCN gas released by the components of the films is reported in the following table, measured as the difference from the green fog of Film I taken as a reference.

TABLE 6

| Film | I | L | M | N | O | P | Q | R | S | T | U | V | Z |
|---|---|---|---|---|---|---|---|---|---|---|---|---|---|
| Fog | Ref | −0.24 | −0.18 | −0.19 | −0.38 | +0.14 | +0.10 | +0.48 | +0.83 | +0.57 | +0.88 | +0.36 | +0.65 |

The data show that heavy metal compounds other than palladium compounds do not act as scavengers for HCN gas released from the film, but on the contrary increase fog versus the reference film.

Formulas or synthesis of compounds used in the present invention will be presented below.

Cyan dye forming coupler C-1:

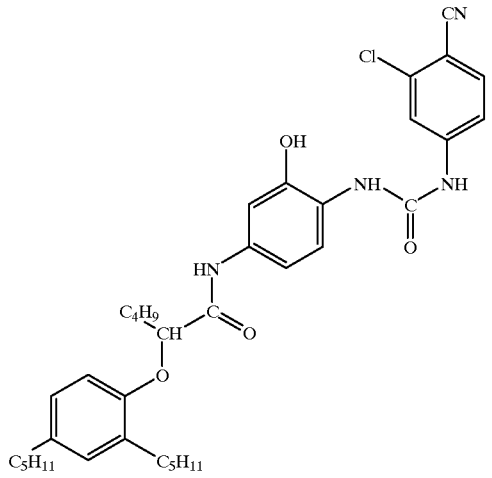

Cyan dye forming DIR coupler C-2:

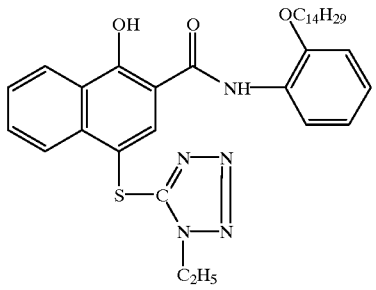

Magenta colored cyan dye forming coupler C-3:

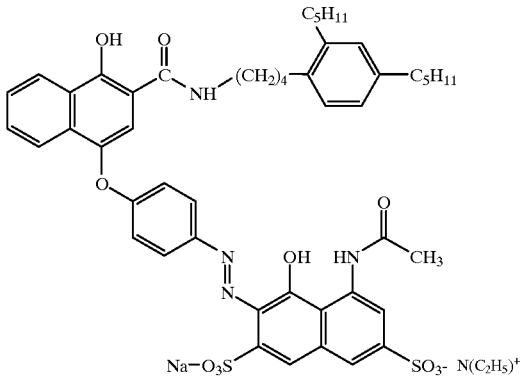

Cyan dye forming coupler C-4:

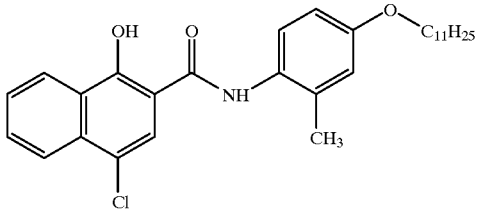

Magenta dye forming coupler M-1:
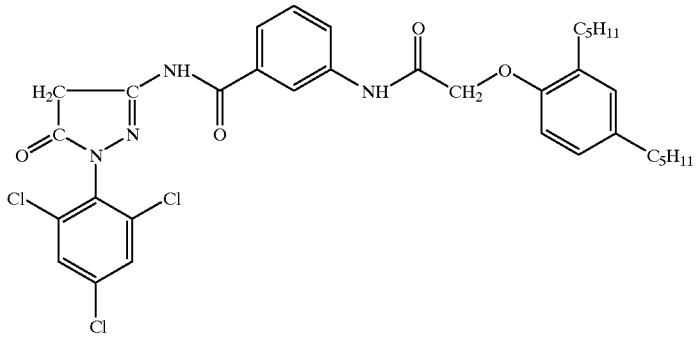
Magenta dye forming DIR coupler M-2:
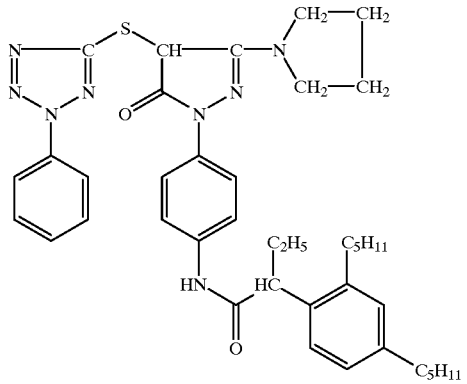
Yellow colored magenta dye forming coupler M-3:
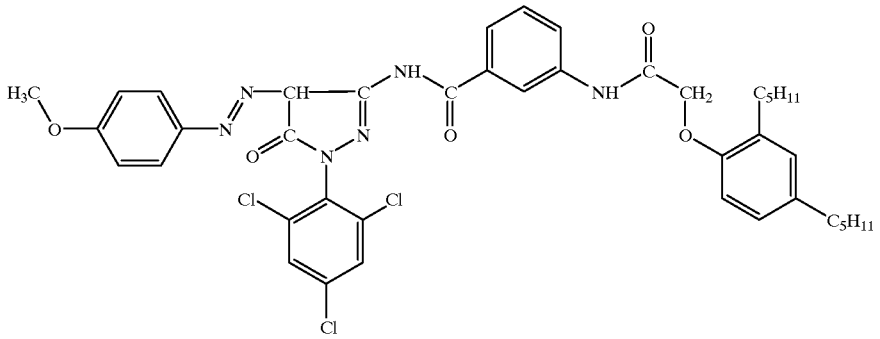

Yellow colored magenta dye forming coupler M-4:
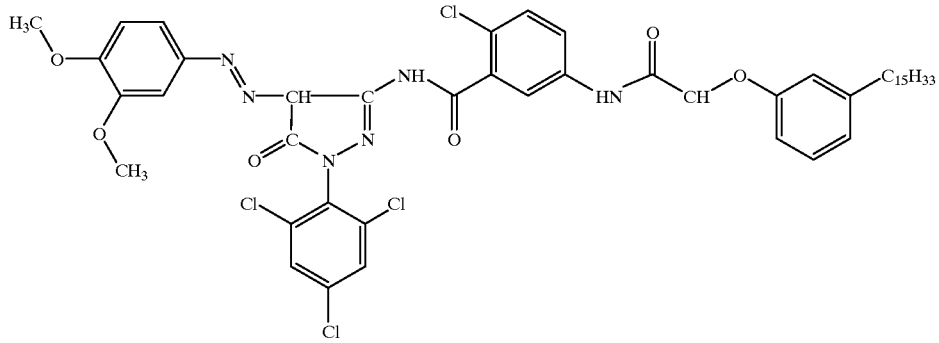
Yellow dye forming coupler Y-1:
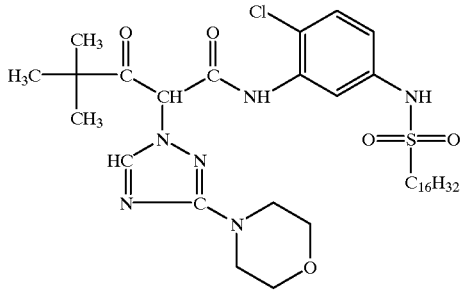
Yellow dye forming coupler DIR coupler Y-2:
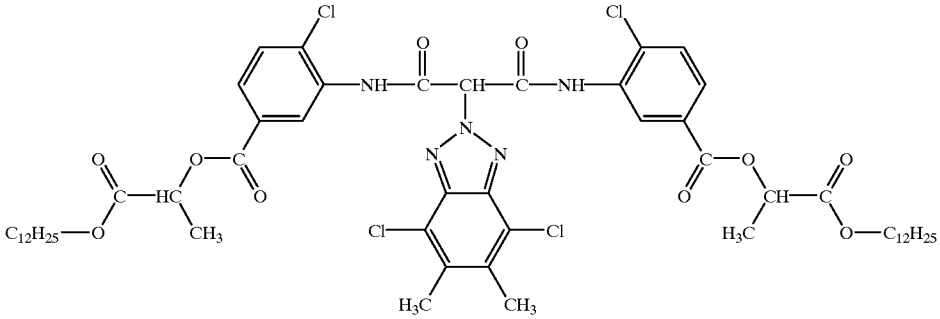
UV absorber UV-1:
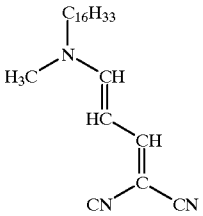
Matting agent MA-1:
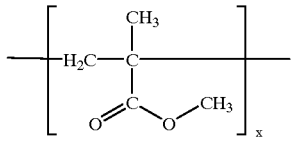
prepared using the polymerization initiator containing cyano groups of formula:
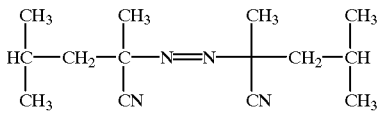
Synthesis of gelatin hardener H-1:
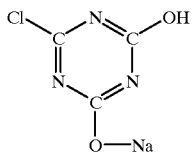

Cyanuric chloride (2,4,6-trichloro-1,3,5-triazine, 0.1 mole) was added in portions to a stirred and cooled solution of NaOH (0.5 mole) in water (500 ml) at a temperature between 20° C. and 25° C. When all cyanuric chloride was dissolved, further NaOH (0.3 mole) was added, followed by cyanuric chloride (0.1 mole), and so on until 0.5 mole of cyanuric chloride and 1.7 mole of NaOH were added. At the end, 0.3 mole of NaOH was added and the mixture was allowed to stirr one more hour. The solution, having a pH of about 13, was then filtered. Water was added to dilute the solution to a concentration of 3% in weight of 2-chloro-4, 6-dihydroxy-1,3,5-triazine sodium salt.

Synthesis of gelatin hardener H-2:

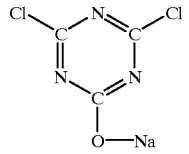

In a vessel equipped with a stirrer, a condenser and a thermometer and cooled with water and ice, 58.4 g of water were mixed with 38.6 g of 1N NaOH under stirring. 3 g of cyanuric chloride (2,4,6-trichloro-1,3,5-triazine) were added in small portions in order to keep the temperature between 10° C. and 20° C. At the end, the mixture was stirred for two hours at the same temperature, then it was filtered. This solution had a pH of about 10.

Gelatin hardener H-3:

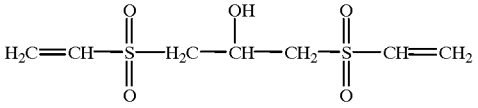

What is claimed is:

1. A photographic assemblage comprising:

a silver halide photographic light-sensitive element comprising at least one sulfur and gold sensitized silver halide emulsion layer, said element comprising chlorinated s-triazine hardeners and chemical compounds containing cyano groups, and a closed vessel in which the element is closed and stored at a constant relative humidity, characterized in that the element contains, in a silver halide emulsion layer and/or an adjacent layer thereto, a divalent or tetravalent palladium salt as scavenger for HCN gas released from the element.

2. The photographic assemblage of claim 1 wherein the palladium salt is contained in the photographic element in an amount of 0.01 to 1 milligrams per gram of silver.

3. The photographic assemblage of claim 2 wherein said palladium salt is present within a layer adjacent to a silver halide containing layer.

4. The photographic assemblage of claim 1 wherein the palladium salt is $K_2PdCl_4$, $Na_2PdCl_4$, or $(NH_4)_2PdCl_4$.

5. The photographic assemblage of claim 4 wherein said palladium salt is present within a layer adjacent to a silver halide containing layer in an amount of from 0.05 to 0.5 milligrams of palladium salt per gram of silver.

6. The photographic assemblage of claim 1 wherein said chlorinated s-triazine hardener is a 2,4-dihalogen-6-hydroxy-1,3,5-triazine, a 2-halogen-4,6-dihydroxy-1,3,5-triazine or a 2,4-dihalogen-6-amino-1,3,5-triazine.

7. The photographic assemblage of claim 6 wherein said palladium salt is present within a layer adjacent to a silver halide containing layer.

8. The photographic assemblage of claim 6 wherein said 2,4-dihalogen-6-amino-1,3,5-triazine corresponds to the general formula:

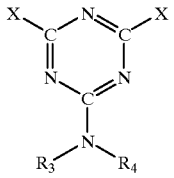

wherein X is halogen and $R_3$ and $R_4$ each independently represents hydrogen, alkyl, aryl, or taken together $R_3$ and $R_4$ represent the elements necessary to complete a cyclic ammino group.

9. The photographic assemblage of claim 8 wherein said palladium salt is present within a layer adjacent to a silver halide containing layer.

10. The photographic assemblage of claim 1 wherein said chemical compound containing cyano groups is a synthetic polymer prepared by an azo-based polymerization initiator containing a cyano group, a cyan dye-forming coupler containing a cyano group, an ultraviolet absorber containing a cyano group, or a dye containing a cyano group.

11. The photographic assemblage of claim 10 wherein said palladium salt is present within a layer adjacent to a silver halide containing layer.

12. The photographic assemblage of claim 10 wherein said cyan dye-forming coupler containing a cyano group corresponds to the general formula:

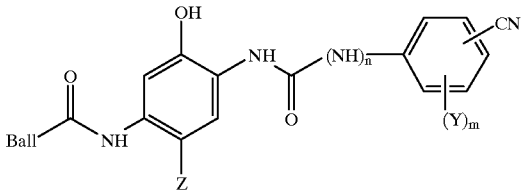

wherein Ball is a ballast group, Z is hydrogen or a removable group upon coupling reaction with oxidized product of a color developing agent, Y is hydrogen, halogen, hydroxy, nitro or monovalent organic group, n is an integer of 0 to 1, m is an integer of 0 to 4, provided that when m is 2 or more, Y's may be the same or different.

13. The photographic assemblage of claim 12 wherein said palladium salt is present within a layer adjacent to a silver halide containing layer.

14. The photographic assemblage of claim 10, wherein said ultraviolet absorber containing cyano groups is represented by the following general formula:

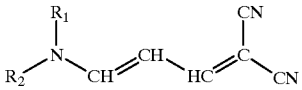

wherein $R_1$ and $R_2$ can be the same or different and represent hydrogen, allyl, alkyl, aryl, except that both $R_1$ and $R_2$ cannot be hydrogen, or taken together $R_1$ and $R_2$ represent the elements necessary to complete a cyclic ammino group.

15. The photographic assemblage of claim 1 wherein said palladium salt is present within a layer adjacent to a silver halide containing layer.

16. The photographic assemblage of claim 15 wherein said hardener is a 2,4-dihalogen-6-hydroxy-1,3,5-triazine which corresponds to the general formula:

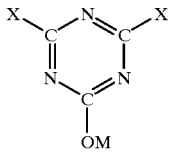

wherein X is halogen and M represents hydrogen.

17. The photographic assemblage of claim 16 wherein said palladium salt is present within a layer adjacent to a silver halide containing layer.

18. The photographic assemblage of claim 15 wherein said hardener is a 2-halogen-4,6-dihydroxy-1,3,5-triazine which corresponds to the general formula:

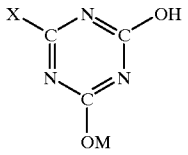

where X is halogen and M represents hydrogen.

19. The photographic assemblage of claim 18 wherein said palladium salt is present within a layer adjacent to a silver halide containing layer in an amount of from 0.05 to 0.5 milligrams palladium salt per gram of silver.

* * * * *

UNITED STATES PATENT AND TRADEMARK OFFICE

CERTIFICATE OF CORRECTION

PATENT NO. : 6,197,485 B1 
DATED : March 6, 2001
INVENTOR(S) : Luigi Cellone, Brunella Fornasari and Giovanni Giusto It is certified that error appears in the above-identified patent and that said Letters Patent is hereby corrected as shown below:

Title page,
Item [73], Assignee, please delete "Minnesota Mining & Manufacturing Company, St. Paul MN (US)" and replace with -- Tulalip Consultoria Comercial Sociedade Unipessoal S.A., Parish of San Pedro, Portugal --

Signed and Sealed this

Sixth Day of August, 2002

*Attest:*

*Attesting Officer*

JAMES E. ROGAN
*Director of the United States Patent and Trademark Office*